United States Patent [19]

Goble

[11] Patent Number: 4,877,237

[45] Date of Patent: Oct. 31, 1989

[54] MULTIPURPOSE STRUCTURE

[76] Inventor: Rowland H. Goble, P.O. Box 423, Lake Mary, Fla. 32746

[21] Appl. No.: 293,070

[22] Filed: Jan. 3, 1989

Related U.S. Application Data

[62] Division of Ser. No. 583,651, Feb. 27, 1984, Pat. No. 4,804,176.

[51] Int. Cl.[4] ..... A63B 17/04

[52] U.S. Cl. ..... 272/54; 272/1 R; 272/85; 272/113; 297/157; 297/159; 297/184

[58] Field of Search ..... 272/1 R, 2, 54, 85–92, 272/113, 60; 297/184, 157, 159, 77

[56] References Cited

U.S. PATENT DOCUMENTS

| | | | |
|---|---|---|---|
| 340,530 | 4/1896 | Tuttle | 272/87 |
| 1,744,594 | 1/1930 | Trzesniewski | 272/85 X |
| 2,616,485 | 11/1952 | Robbins | 272/85 X |
| 3,643,942 | 2/1972 | Williams | 272/85 X |

FOREIGN PATENT DOCUMENTS

| | | | |
|---|---|---|---|
| 1014182 | 7/1977 | Canada | 272/85 |
| 2355455 | 7/1974 | Fed. Rep. of Germany | 272/113 |

OTHER PUBLICATIONS

Popular Mechanics, vol. 112, No. 1, Jul. 1959, p. 182.

*Primary Examiner*—Richard E. Chilcot, Jr.
*Attorney, Agent, or Firm*—William M. Hobby, III

[57] ABSTRACT

A multipurpose structure apparatus includes a frame and a roof supported on the frame. A swing is movably supported to the roof in one position and is held adjacent the roof in a raised second position. A table and bench section are stored on the structure and attached to the frame to form a table and bench structure with the frame beneath the swing. The structure also includes brackets for attaching a steel pipe across frame members for supporting one or more see-saw boards and a plurality of pivoting frame members can be held with chains for supporting boards for use as seats or plant holders. The structure also provides for a pair of pivoting ladder members pivoting from the roof of the structure in a spaced apart relationship. The spaced ladder members can be pivoted to a position adjacent the roof and attached thereto for storage when not in use and can have a board member connected therebetween to form a rocking seat when in an operative position. The ladder members may also have individual seats attached thereto with attaching members on one portion with chains holding the other portion for rocking with the swinging of the ladder members.

7 Claims, 4 Drawing Sheets

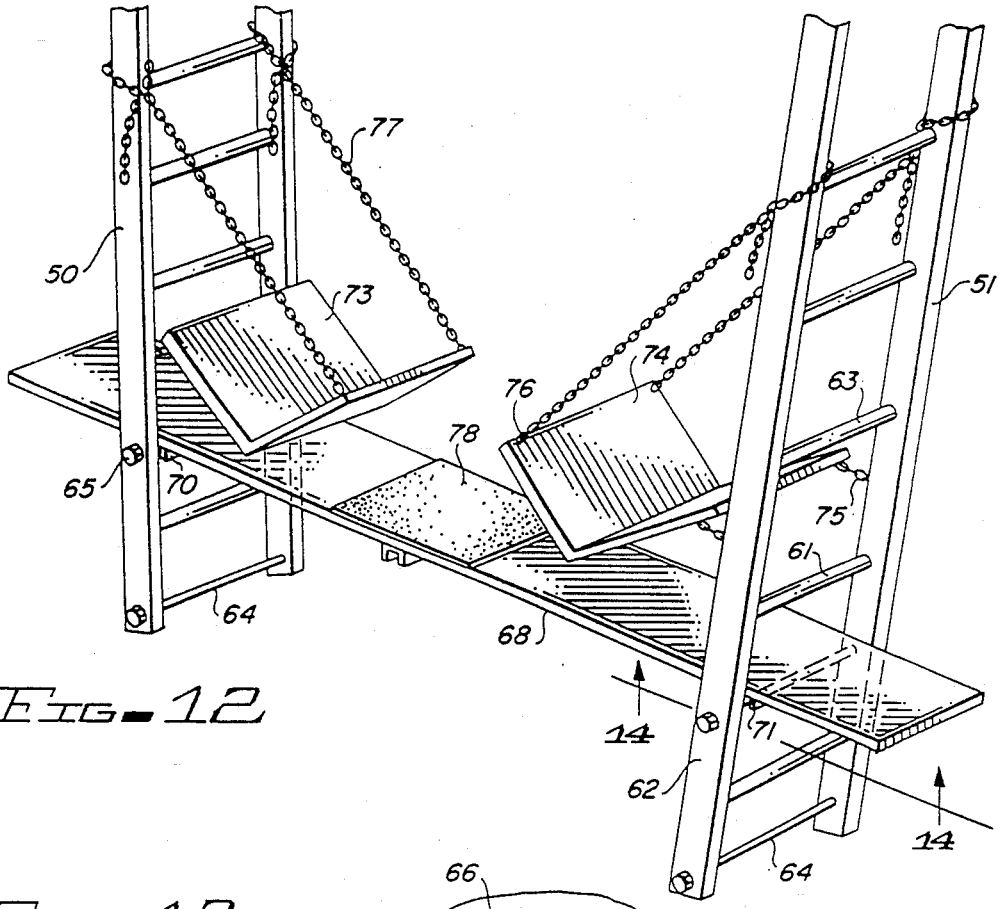
FIG. 12
FIG. 13
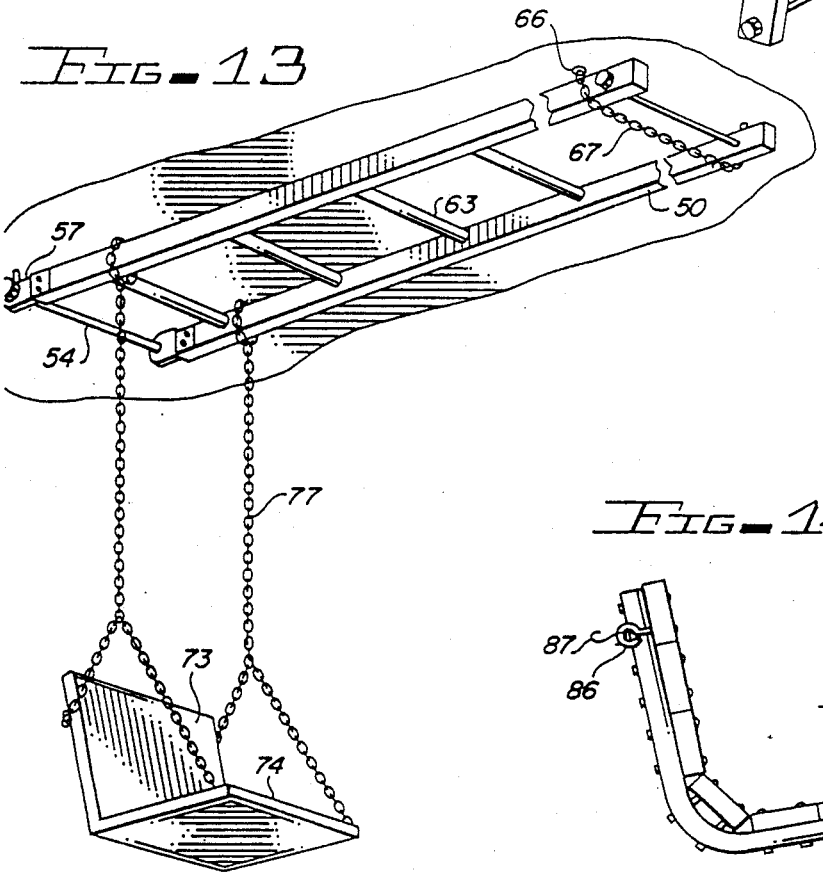
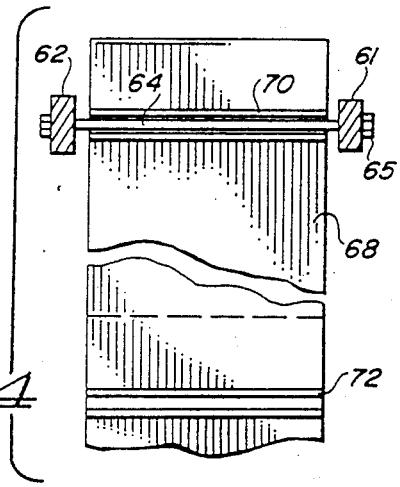
FIG. 14
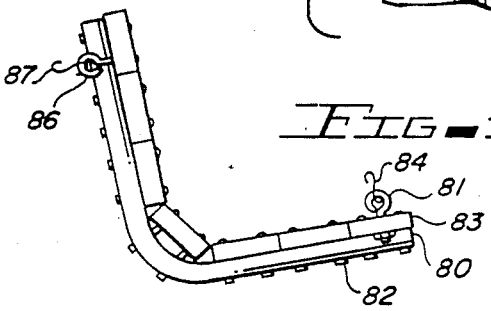
FIG. 15

MULTIPURPOSE STRUCTURE

This is a division of application Ser. No. 583,651, filed on Feb. 27, 1984 now U.S. Pat. No. 4,804,176.

BACKGROUND OF THE INVENTION

The present invention relates to multipurpose structures and especially to a multipurpose roofed structure which may have one or more swings, tables, benches, see-saws, rocking boards, chairs, sun roofs and the like.

It has been common in the past to provide a variety of multipurpose frames such as used in exercise equipment and to provide structures for placement in a person's yard or at a public park which allows people to use picnic tables, benches, swings and an assortment of other equipment. Typically, prior art structures for outdoor use, which have roofs, resemble gazebos and merely provide seating and picnic tables. A few structures provide a variety of entertainment in one piece of equipment and it is common to place bench type swings on screen porches. Typical prior art structures with combined different functions may be seen in the Upton U.S. Pat. No. 1,204,616 for a portable frame for tents which includes a frame for a tent which can support several types of swings. In the Trzesniewski U.S. Pat. No. 1,744,594 an entertainment and athletic apparatus for use by children is provided which may have a roof, a floor, a swing, a punching bag, and a sandbox. In the French U.S. Pat. No. 532,047, a foldup hammock is provided while in the Amrock, U.S. Pat. No. 287,078 a convertible settee, cot and tent has a tent roof and frame and a seat which can be converted to a cot. U.S. Pat. No. 2,790,452 to Dusek shows a canopy construction in which a roof structure has a picnic table and benches therein. In U.S. Pat. No. 795,711 to Krieg, a portable swing has a frame structure with a roof and a pair of rocking swings mounted therein. U.S. Pat. No. 404,614 to Gifford shows a roofed structure having a hammock therein while U.S. Pat. No. 313,757 to Nelson shows an awning having a table board connected to the frame thereof.

The present invention advantageously provides a series of functions in a rigid frame in which each of the functions of the structure are stored on the structure for rapid setup for a variety of utilizations so that a bench type swing can be rapidly stored and replaced with a picnic table and bench which can be rapidly changed to a see-saw while the roof of the structure can be used for a sun roof.

SUMMARY OF THE INVENTION

A multipurpose structure apparatus includes a frame for supporting a roof and adapted to accept a plurality of functional items for storage and use thereon. A bench type swing is movable supported to the roof in one position and has supporting means for supporting the swing in a raised second position to the roof. Table and bench members are stored on the frame and may be attached to the frame to form a table and bench on the structure under the swing when the swing is in its raised position. The bench and table components are easily stored on the frame under the roof. A steel pipe bracket is attached to the frame for supporting a steel pipe thereacross which operates in conjunction with the table and bench components to form one or more see-saws within the frame structure. A plurality of pivoted frame members can be pivoted to a position for support by a chain to hold boards for forming benchs, clamp supports, or the like, on parts of the frame. In addition, the roof can be formed to act as a sun roof and a pair of spaced ladder members can be used as a ladder to get onto the sun roof and are pivoted to the roof frame. The spaced ladder members can be swung adjacent the roof and attached for storage and then released to hang in a vertical direction. In a vertical direction the two ladder members can be attached by a board at different levels to provide an amusement device for swinging back and forth and to provide connections for a pair of rocking seats which can be attached to each ladder member. The attached seats are connected with hook and eyes on the one side and held by chains on the other. The board or boards supporting the ladder members together may be one of the boards used in forming the table and bench or the see-saw and have a pair of U-shaped channels on the bottom thereof for hooking onto a ladder of each ladder member.

BRIEF DESCRIPTION OF THE DRAWINGS

Other objects, features and advantages of the present invention will be apparent from the written description and the drawings in which:

FIG. 12 is a perspective view of a swing in accordance with FIG. 10 having a different setup;

FIG. 13 is a perspective view of a portion of the swing in FIGS. 10 and 12 in a stored position having a swing attached thereto;

FIG. 14 is an elevational view taken on the line 14 of FIG. 12; and

FIG. 15 is a side elevation of a swing for use in accordance with the present invention.

DESCRIPTION OF THE PREFERRED EMBODIMENT

Figure 1:
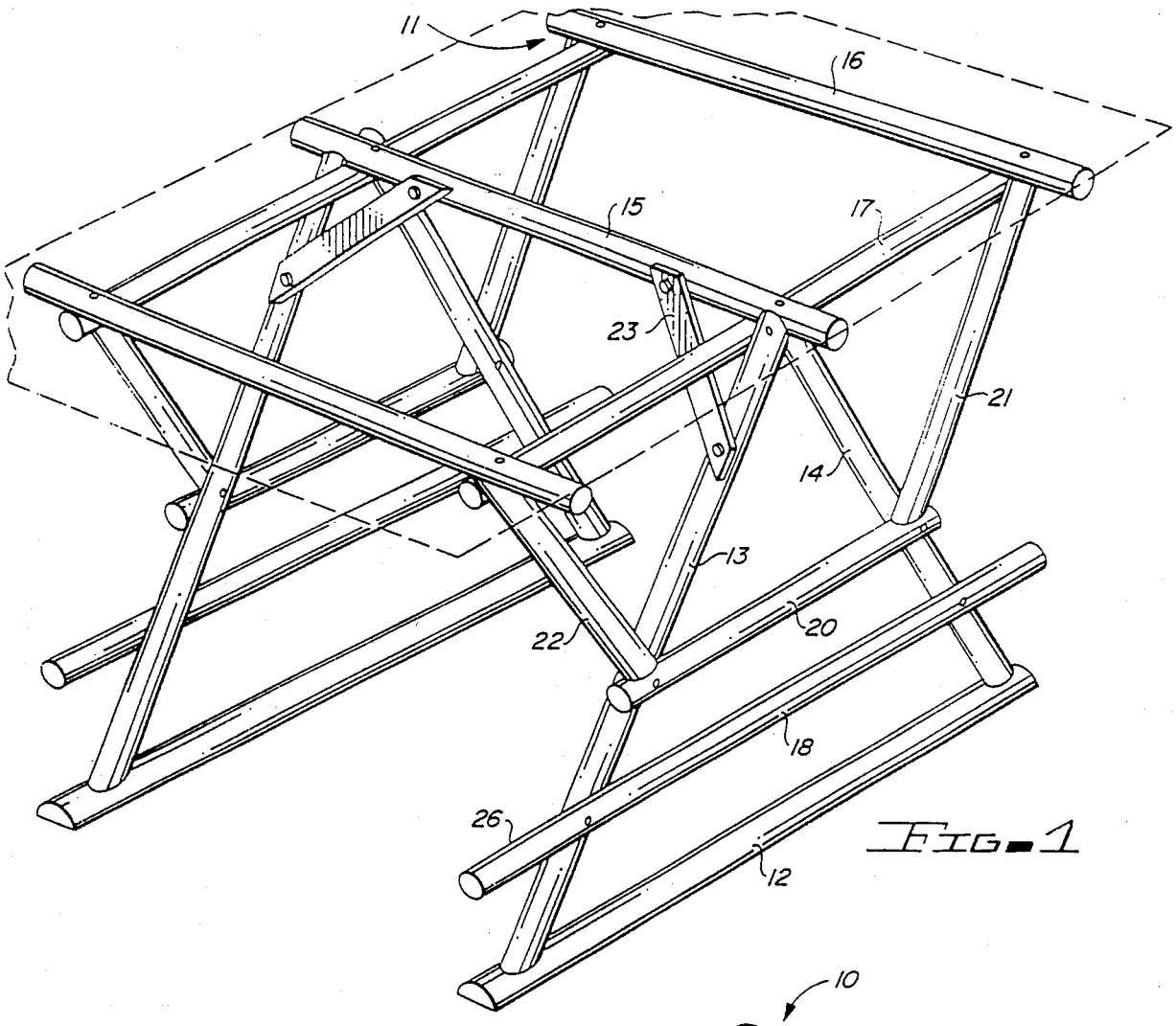
FIG. 1 is a perspective view of a frame structure in accordance with the present invention.
Figure 2:
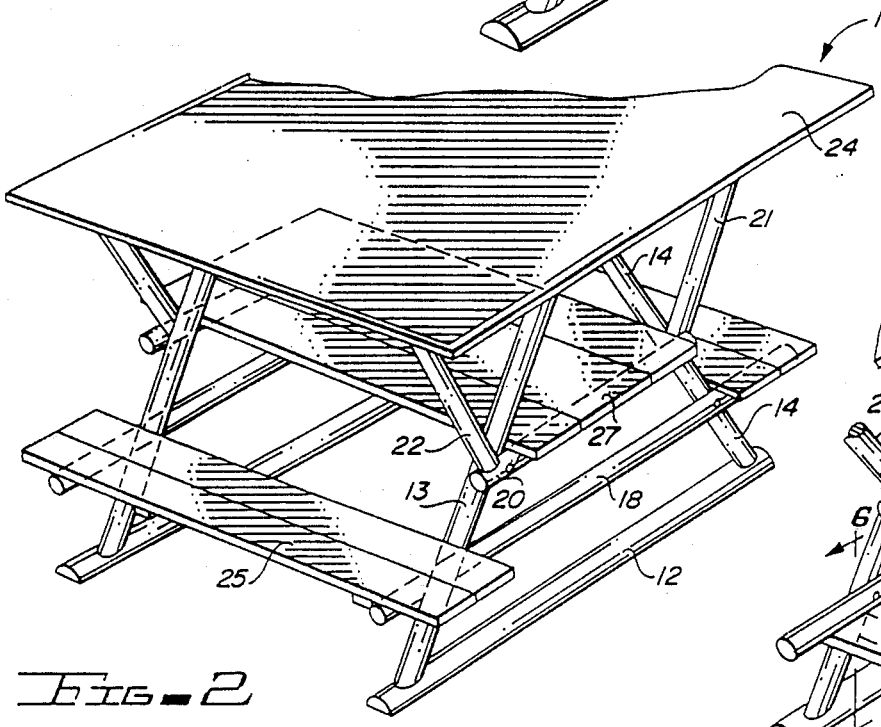
FIG. 2 is a partial perspective view of a structure in accordance with the present invention having a bench and table formed thereon.

Referring to the drawings and especially to FIGS. 1 through 9, a multipurpose structure 10 has a frame 11 which includes at least a pair of base members 12 for positioning on the earth and for supporting a floor if desired. The base members have a pair of inverted V-shaped support frame members 13 and 14 on each side of the structure 10 and connected to a central rafter 15. A plurality of additional rafters 16 are attached to a pair of joist 17. The frame members 13 and 14 have a lower cross brace 18 and an upper cross brace 20 connected between the frame members 13 and 14 on either side of the structure 10. Cross brace member 20 has a pair of angled frame members 21 and 22 connected thereto and extending to the outer rafters 16 adjacent the joist 17. Further cross bracing may be provided with bracing members 23 attached between the frame members 13 and 14 and the central rafter 15. As shown, the frame work 11 is assembled with bolts from small poles or logs so that it can be rapidly assembled from a kit In Situ. However, it will be clear that a metal framework can be just as easily used if desired and that the members shown in the figures can be attached with fasteners other than bolts without departing from the spirit and scope of the invention.

Figure 3:
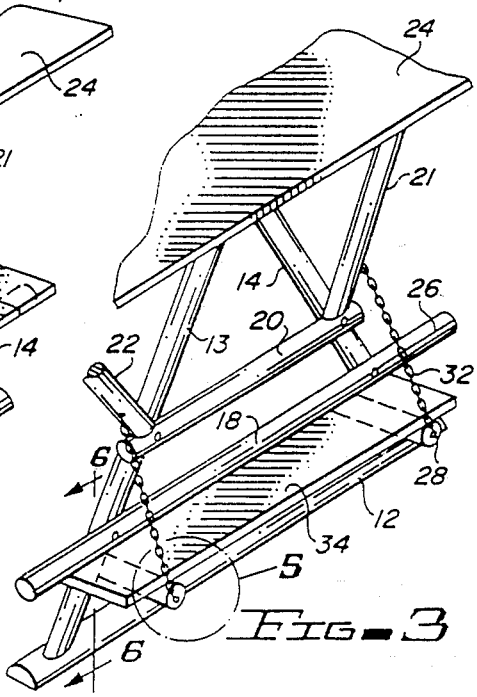
FIG. 3 is a partial perspective view of the structure of FIGS. 1 and 2 having pivoted arms for adding additional supports thereto.
Figure 4:
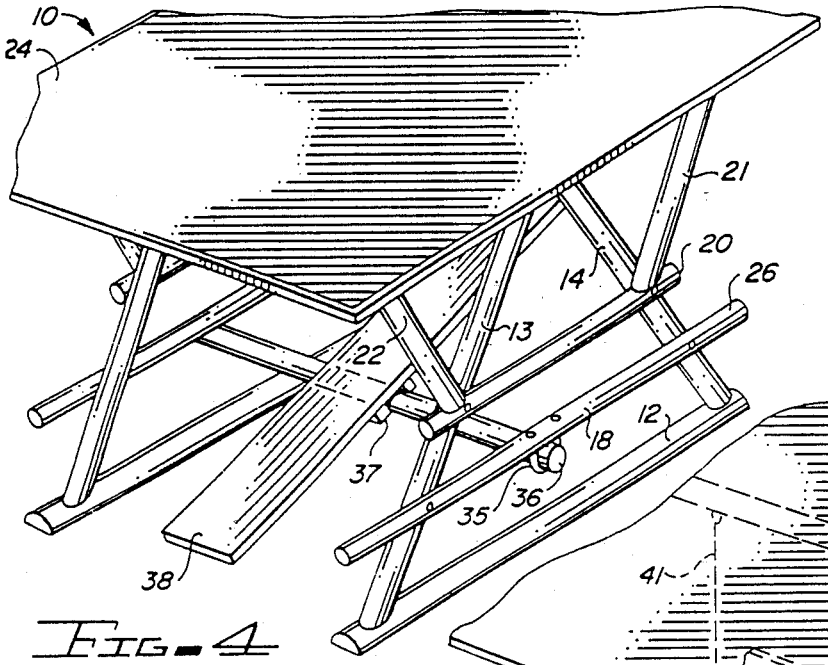
FIG. 4 is a perspective view of the embodiment of FIGS. 1 through 3 converted to use as a see-saw.
Figure 7:
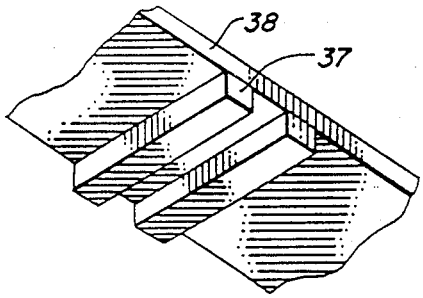
FIG. 7 is a partial bottom perspective view of a see-saw board.
Figure 5:
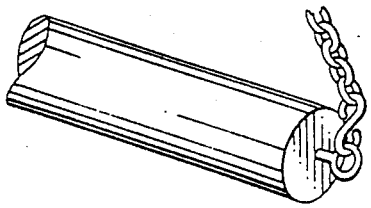
FIG. 5 is a partial perspective of one of the drop-down arms of FIG. 3.
Figure 6:
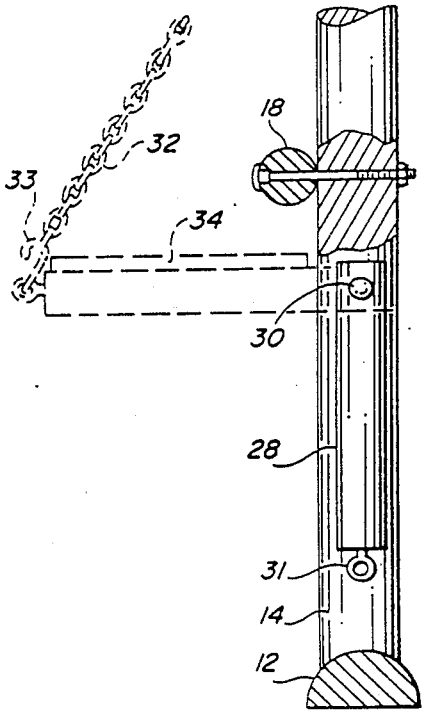
FIG. 6 is an end elevation of one of the arms of FIGS. 3 and 5 having a board attached thereto.
Figure 9:
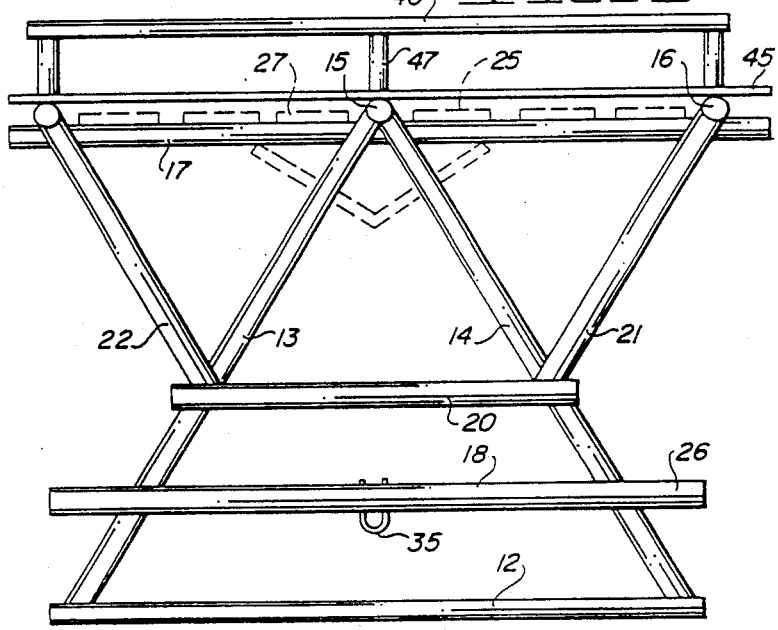
FIG. 9 is a side elevation of the structure having the swing and table and bench components in storage and having a sun roof mounted on the structure roof.
Figure 10:
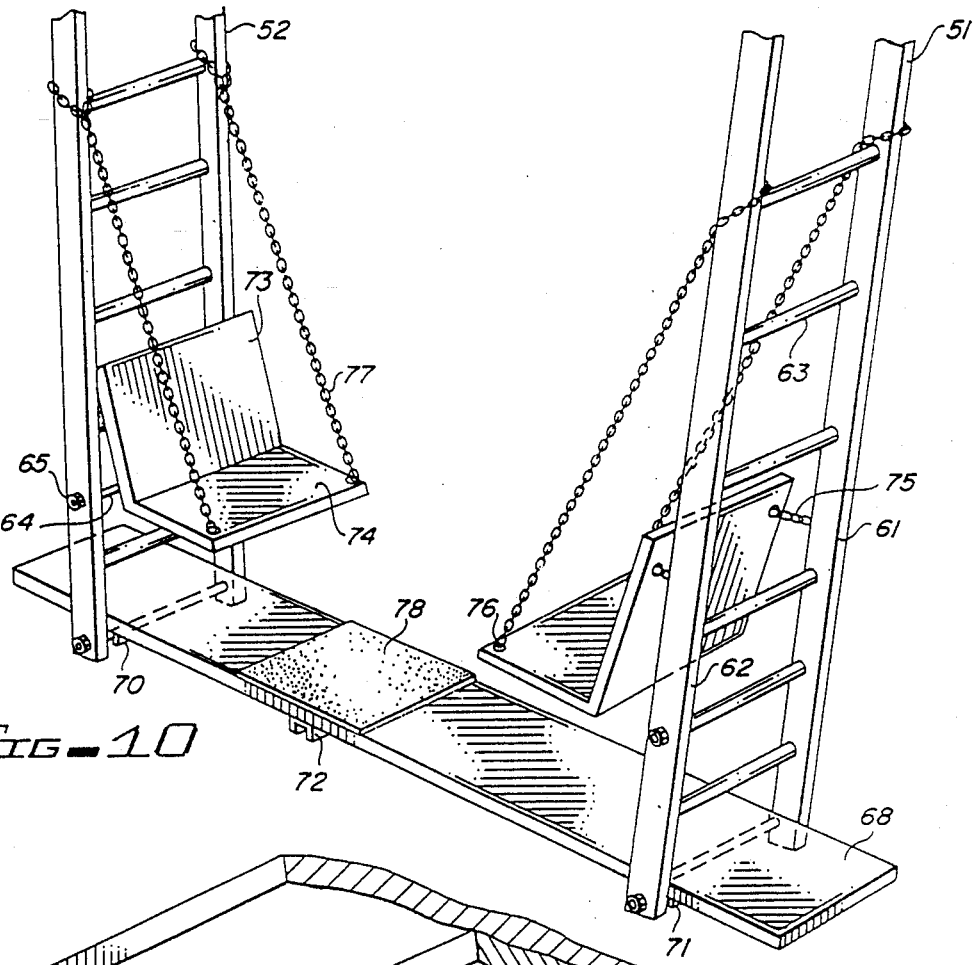
FIG. 10 is a perspective view of an alternate embodiment of a swinging apparatus for the structure of FIGS. 1 through 9.
Figure 11:
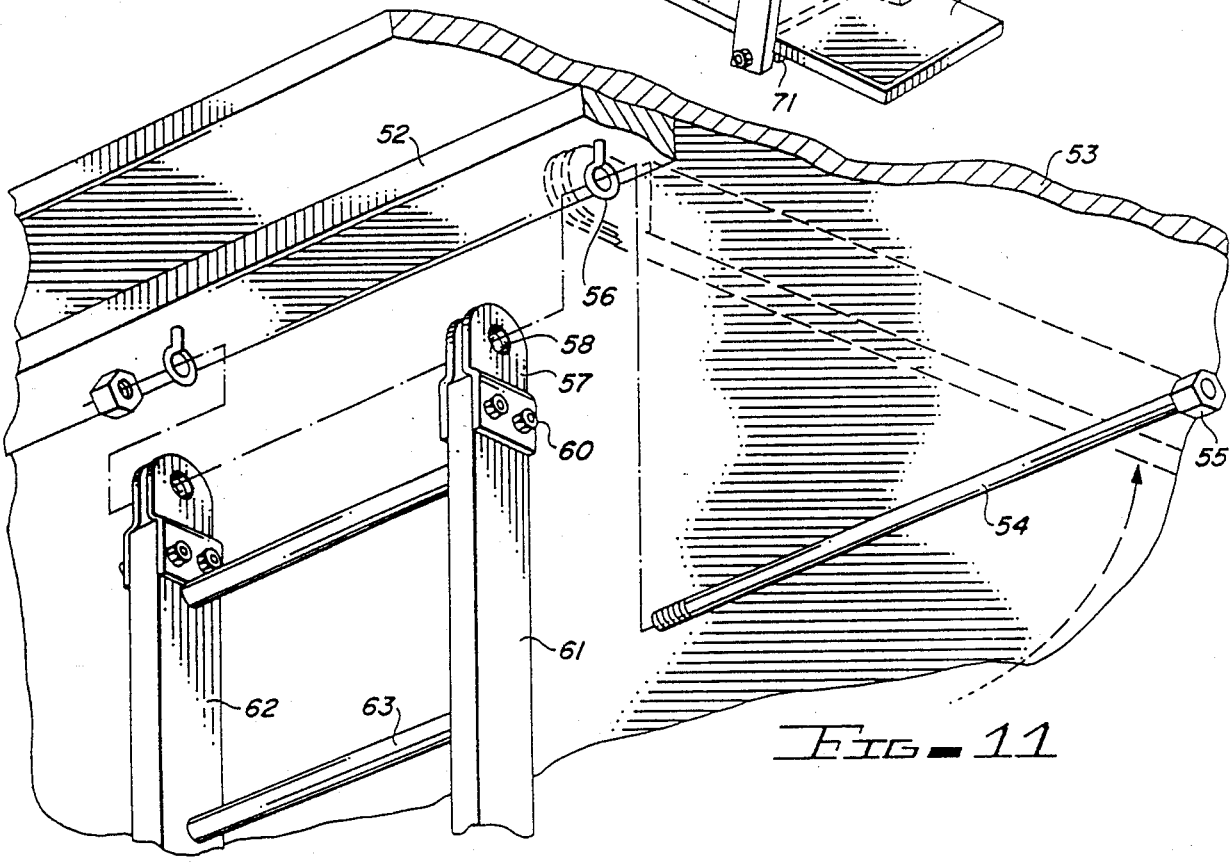
FIG. 11 is a cutaway exploded perspective view of the roof support for the swinging portion of FIG. 10.

The structure 10 having the framework 11 has a roof 24 placed on the rafters 15 and 16 and attached thereto. If the roof is to act as a sun roof as shown in FIG. 9, it would be made of a heavy board or plywood having a coating to prevent leakage into the structure which may be used in the rain or to shade from direct sunlight. In FIG. 10 a plurality of bench table components or members 25 have been removed from storage under the roof 24 on the joist 17 as shown in FIG. 9 and placed across the upper cross bracing 20 and on protruding portions 26 of the lower cross bracing 18. The bench components 24 are placed on the extended portions 26 of the cross bracing 18 to form a pair of picnic benches while the table components 27 are placed on the upper cross bracing 20 between the frame members 13 and 14 to form a table such as a picnic table. Additional seating may be provided as shown in FIGS. 3, 5 and 6 by a pair of pivoted arms 28 attached to the frame members 13 and 14 on either side of the structure 10 and pivoted on a bolt 30 and having an eyelet 31 attached on each end thereof. Swinging the pivoted arms 28 into a horizontal position allows a chain 32 attached to the frame members 13 and 14 to connect to the eyelet 31 with the hook member 33 to hold the arms 28 in a horizontal position where a board 34 can be placed thereacross to provide either additional seating or a support for flower pots or the like. When not being used, the arms 28 can be disconnected from the chains 30 and swung down as shown in FIG. 6 and the boards 34 can be stored on the joist 17 as shown in FIG. 9. In FIG. 4, the structure 10 having the roof 24 thereon has a U-shaped bolt 35 attached through the cross brace member 18 and attached thereto and has a galvanized steel pipe 36 attached thereacross to extend from one cross brace member 18 on one side of the structure 10 to the cross brace member 18 on the other side of the structure. One of the stored table and bench components stored as shown in FIG. 9 may have a pair of blocks 37 attached to the center thereof or a plurality of blocks 37 or U-shaped channels attached thereto for holding the board 38 to the steel pipe 36 as shown in FIG. 4. The board 38 would, of course, be stored as shown in FIG. 9 and could be used as one of the support boards in FIG. 3 or one of the table boards 27 or bench boards 25.

Figure 8:
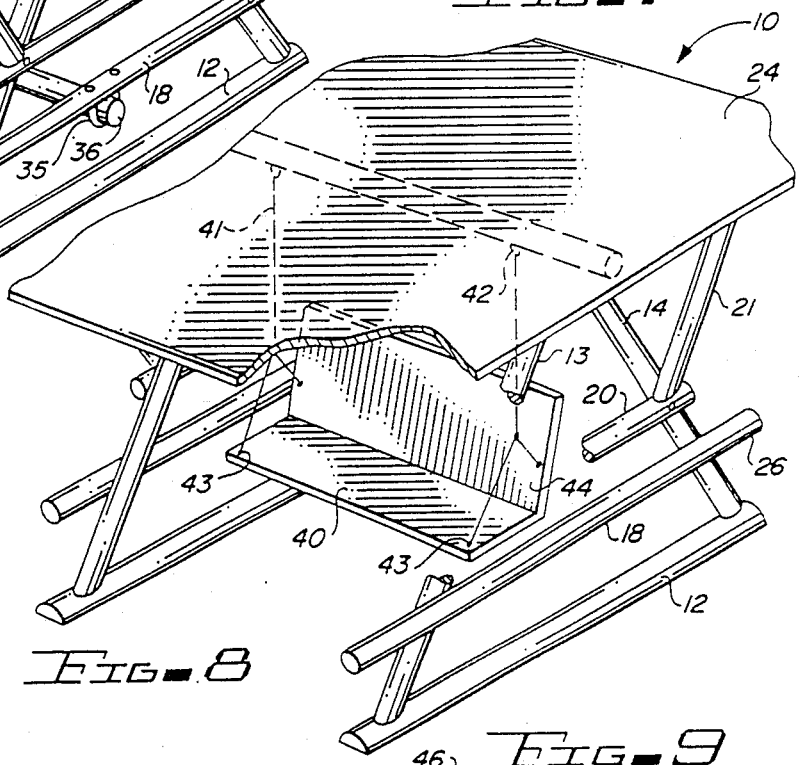
FIG. 8 is a cutaway perspective view of the structure of FIGS. 1 and 2 having a swing mounted thereon.

In FIG. 8, the structure 10 has a bench seat type swing 40 attached to the rafters 15 which is directly supported by the angled frame members 13 and 14 with a pair of chains 41 connected to a pair of eyelets 42. A pair of eyelets 43 on each arm 44 of the swing 40 supports the swing to the chain 41. When the swing 40 is not in use or when the picnic table of FIG. 2 or the see-saw in FIG. 4 are desired to be set up, the swing 40 is raised as shown in FIG. 9 with the chain 41 being used to attach the swing in its raised position using a pair of S-shaped hooks to grab the chain links. FIG. 9 shows the structure in accordance with the present invention having an optional sun deck 45 attached to the rafters 15 and 16 and having a sun deck railing 46 attached therearound with posts 47. This allows the structure to be used as a sun deck by some members of the family while others are using the part directly below to shade from the sun while using a swing, see-saw or picnic table in accordance with FIGS. 3, 4 and 8 with or without seating along the side of the structure in accordance with FIG. 3.

FIGS. 10 through 15 shows another set of attachments for the multipurpose structure 10 in which a pair of ladder members 50 and 51 are mounted to spaced rafters 52 of a roof 53. The ladder members 50 and 51 are pivotably mounted with a support shaft 54 having nuts 55 on each end thereof passing through a pair of hanging eyelets 56 and through a pair of support brackets 57 on the end of each of the ladder members 50 and 51. The aperture 58 in the bracket 57 allows shaft 54 to be positioned therethrough to allow the pivoting movement of the ladder members 50 and 51. The brackets 57 are bolted with bolts 60 to the end of the vertical support members 61 and 62 each having a plurality of rungs 63 attached thereto. Some or all the rungs may be of steel pipe or rod 64 bolted to each end with a nut 65. The ladder members 50 and 51 may be utilized for gaining access to the sun roof of FIG. 9. The pivoted structures may be swung to the roof 53 and attached as shown in FIG. 13 to hooks 66 utilizing chain 67 or directly with S-type hook members. One would, of course, be placed on top of the other. The ladder members 50 and 51 can be released at one end from storage against the roof 53 and allowed to hang in a vertical direction in a spaced relationship to each other and a board 68 may also be the see-saw board of FIG. 4 or one of the table or bench boards of FIG. 2 may have a pair of U-shaped brackets 70 and 71 attached thereto. The U-shaped brackets 72 shown in FIG. 10 is centered for use of the same board as a see-saw board in accordance with FIG. 4. The U-shaped brackets 70 and 71 fit on the metal pipes 64 to hold the ladder members 50 and 51 in a parallel spaced relationship when the members are pivoted on the rod 54 of FIG. 11. Thus, a person can stand or sit on the board 68 and the position can be either an upper or lower position and swing back and forth while holding onto rungs 63. Alternatively, a pair of rocking seats 73 and 74 may have their backs attached to an eyelet 75 attached to the vertically extending members 61 and 62 and may have the seat portions of the seats 73 and 74 attached to the vertically extending members 61 and 62 and may have the seat portions of the seats 73 and 74 attached to eyelets 76 which are in turn attached to chain members 77 which can be hooked around the vertical supports 61 and 62 adjacent a rung 63. In this position, one person can seat in each chair 73 and 74 with their feet on a carpeted portion 78 while the swinging ladder members 50 and 51 are swung on their pivot points in a spaced parallel relationship to thereby swing and rock persons seating in the seats 73 and 74.

Seats 73 and 74 and the board 68 can be adjusted as shown in FIG. 12. One of the seats 73 and 74 can be attached to the stored ladder members 50 or 51 as shown in FIG. 13 using the chain 77 to provide an individual swing. FIG. 15 shows the shaft 64 sitting in the angled bracket 70 having a rung member 61 and 62 on either side thereof and a nut 65 holding the shaft 64 in position. U-shaped channels are supported to the board 68 and includes a center U-shaped channel 72 for use of the same board as a seesaw member. FIG. 15 shows a preferred construction for the swing seat members and FIGS. 10 and 12 and also in FIG. 8 a pair of bent steel pipe members 80 have had a plurality of holes drilled therethrough for attaching bolts 81 held by nuts 82 for attaching a plurality of swing slats 83. The slats can have eyelets 84 attached thereto for an S-shaped hook member 85 and an upper eyelet 86 for an S-shaped member 87.

It should be clear at this point, that a multipurpose structure has been provided which allows the storage of all the components thereon and the quick movement of various components from storage to an operating position or from operating position back into the storage position. Thus, the structure serves as a multipurpose gazebo for a person's porch yard while providing entertainment and relaxation through various types of swings, seats, picnic tables, as well as a sundeck. It should, however, also be clear that the structure is designed to be readily manufactured, shipped and sold in kit form ready to assemble by a handymen on the site where the structure is to be used and that the frame of the structure is designed along the general shape of a truss to provide greater strength and rigidity for supporting the different functions that the structure is to be utilized with. Accordingly, the present invention is not to be construed in accordance with those forms which are to be considerd illustrative rather than restrictive.

I claim:

1. A multipurpose structure comprising in combination:

a frame having a plurality of frame members;

a roof supported by said frame;

a first ladder member having a plurality of rungs pivoted from one end thereof to said frame;

a second spaced ladder member having a plurality of rungs pivoted from one end thereof to said frame;

means to support said first and second ladder members adjacent to said roof in one position for storage and in a hanging pivoting position in a second position thereof;

fastener means attached to said frame for holding said first and second ladder members in a raised storage position; and a connecting board operatively and removably connected between said first and second spaced ladder members for holding said ladder members in a predetermined spaced relationship when swinging said first and second ladder members on their pivots whereby a multipurpose structure provides for a storable swinging portion.

2. A multipurpose structure in accordance with claim 1, in which said connecting board has a pair of U-shaped channels attached thereto for fitting over one rung of said plurality of rungs of said first ladder member and over one rung of said plurality of rungs of said second ladder member for holding said first and second ladder members in a predetermined spaced relationship.

3. A multipurpose structure in accordance with claim 2, in which said first ladder member and said second ladder member each has a seat attached thereto.

4. A multipurpose structure in accordance with claim 3, in which each of said seats attached to said first ladder member and said second ladder member is attached with fastener members attached to the back of said seat for attaching to said first and second ladder members and fastening members attached to the seat portion of each said seat for connecting flexible support members between said seat fastening means said second ladder members.

5. A multipurpose structure in accordance with claim 4, in which said fastening members are eyelets.

6. A multipurpose structure in accordance with claim 5, in which said flexible support members are chains attached to said eyelets and extending around said ladder members.

7. A multipurpose structure in accordance with claim 1, in which said first and second ladder members each have brackets attached to one end thereof having apertures therethrough for fitting onto a steel shaft supported on said roof frame portion for pivotably supporting said first and second ladder members.

* * * * *